United States Patent [19]

Watanabe et al.

[11] Patent Number: 4,759,663

[45] Date of Patent: Jul. 26, 1988

[54] METHOD OF PLACING CONCRETE INTO A STEEL ENCASEMENT

[75] Inventors: Hideo Watanabe; Tomoo Suzuki, both of Yokohama; Takayoshi Ota, Tokyo; Gaku Matsumoto, Tokyo; Tomohiro Bessho, Tokyo; Tamiki Koyama, Tokyo; Katuhiko Kimura, Tokyo; Yasuo Kajioka, Tokyo; Minoru Imai, Tokyo, all of Japan

[73] Assignees: Nippon Kokan K.K.; Shimizu Construction Co., LTD., both of Japan

[21] Appl. No.: 932,727

[22] Filed: Nov. 19, 1986

[30] Foreign Application Priority Data

Apr. 4, 1986 [JP] Japan ..... 61-78006

[51] Int. Cl.[4] ..... E02D 15/00

[52] U.S. Cl. ..... 405/217; 264/34; 264/267; 52/743; 405/222

[58] Field of Search ..... 425/147; 264/34, 35, 264/267, 308; 52/743; 405/203, 204, 217, 222, 223

[56] References Cited

U.S. PATENT DOCUMENTS 2,903,877 9/1959 Meade ..... 52/223 R
3,492,395 1/1970 Breitfuss ..... 264/308
4,655,642 4/1987 Birdy et al. ..... 405/217

FOREIGN PATENT DOCUMENTS 2349865 4/1975 Fed. Rep. of Germany ..... 52/743
2452247 5/1975 Fed. Rep. of Germany .
3141272 5/1983 Fed. Rep. of Germany .
3141273 5/1983 Fed. Rep. of Germany .

*Primary Examiner*—John E. Murtagh
*Assistant Examiner*—Andrew Joseph Rudy
*Attorney, Agent, or Firm*—Scully, Scott, Murphy & Presser

[57] ABSTRACT

A method of placing concrete into a steel encasement constructing an offshore structure. The steel encasement is erected. A plurality of first concrete injection holes are formed through the steel encasement in a heightwise spaced manner. The concrete is injected through the lowest disposed concrete injection hole into the erected steel encasement to a level below another concrete injection hole disposed just above said lowest disposed concrete injection hole. Then, the injection step is repeated in connection with a subsequent first concrete injection hole nearest to the level, to which the concrete has been placed, for placing the concrete into the steel encasement to a predetermined level.

8 Claims, 6 Drawing Sheets

METHOD OF PLACING CONCRETE INTO A STEEL ENCASEMENT

BACKGROUND OF THE INVENTION

The present invention relates to a method of placing concrete into a steel encasement by injection for constructing a composite member of a concrete-steel structure.

There has been proposed a method of constructing an offshore platform using such composite members which are produced by placing concrete into steel encasements. Composite members provide excellent watertightness and high breaking strength to the offshore platform and make reinforcing steel and formworks unnecessary. Thus, the composite member is the most suitable for the ice-resisting member of the offshore platform.

FIG. 1 illustrates a typical example of the offshore platform, which has a deck A to be installed with equipments for drilling offshore oil wells and an octagonal supporting structure B for supporting the deck A. The supporting structure B includes ice-resisting trapezoidal slanted walls 2, rectangular vertical walls 3 for providing rigidity to the offshore platform and a bottom slab 4 on which the vertical walls 3 are erected. The bottom slab 4 is placed on the sea bed 1 for transmitting force, exerted on the vertical walls 3, to the sea bed 1. As clearly seen from FIG. 3, vertical walls 3 include multiple walls circumferentially parallel and radial walls disposed radially outwards from the central portion of the platform. As shown in FIG. 2, the slanted walls 2 and the vertical walls 3 are constructed by placing concrete 6 into their slanted steel encasements 7 and vertical steel encasements 8, respectively. As illustrated in FIG. 4A, each slanted steel encasement 7 includes a pair of parallel upper and lower wall plates 11 and 13 which are opposed to each other to form a space between them for containing concrete 6. Each vertical steel encasement 8, as shown in FIG. 4B, includes a pair of parallel outer and inner wall plates 15 and 17 opposed to each other to form a space between them for containing concrete 6. The steel encasements 7 and 8 are closed at their lateral edges with steel plates and have inner stiffeners 9 mounted in a lattice shape on the inner faces of their wall plates 11, 13; 15, 17. These inner stiffeners 9 ensure integrity of slanted and vertical steel encasements 7 and 8 to the concrete 6 placed into them. However, the inner stiffeners 9 make it difficult to fill concrete into slanted steel encasements 7 and vertical steel encasements 8 and also make compaction of the concrete placed and treatment of joints thereof difficult. As shown in FIG. 2, the slanted steel encasement 7 consists of an upper portion 7A, an intermediate portion 7B and a lower portion 7C. The vertical steel encasements 8 are named first vertical steel encasements 8A, second vertical steel encasements 8B, third vertical steel encasements 8C . . . from the outside. The heights of the second and the fourth vertical steel encasements 8B and 8D are about 30 m and 50 m respectively.

For overcoming the problem relating to infilling concrete 6 into the steel encasements 7 and 8, there has been proposed a method as illustrated in FIG. 5. For placing concrete 6 into, for instance, the second vertical steel encasement 8B, the concrete 6 is supplied by means of a chute 10 from an upper end opening 12 of an erected vertical steel encasement piece 8′ into the piece 8′ as illustrated in connection with the third and the fourth vertical steel encasement 8D and is compacted with a rod vibrator 14 or a like device. The concrete 6 is supplied to the chute 10 by means of a bucket 16 suspended from a crane 18. The rod vibrator 14 is inserted from the open end 12 into the vertical steel encasement piece 8′ and held there by an operator on a scaffold 20 which is set beside the vertical steel encasement piece 8′ as shown in connection with the vertical steel encasement 8B. After the placing of the concrete 6, another steel encasement piece 8″ is carried by another crane 18 and is welded at its lower open end to the upper open end 12 of the steel encasement piece 8′ into which the concrete 6 has been placed. In the same manner, concrete 6 is placed into another steel encasement piece 8″. When the vertical wall 3 is erected to a predetermined height in this manner with respect to the second vertical steel encasement 8B, the lower portion 7C of the slanted steel encasement 2 is jointed to the upper ends of the first and second vertical steel encasements 8A and 8B, already filled with concrete 6, and is then filled with concrete 6 in the same manner as the second vertical steel encasement 8B.

Alternatively, concrete may be placed into slanted steel encasements 7 and vertical steel encasements 8 as illustrated in FIG. 6, in which the vertical steel encasements 8 have openings 12A formed through their inner wall plates 17 and the slanted steel encasements 7 have openings 12A formed through their upper wall plates 11. Concrete 6 is placed into the slanted and vertical steel encasements 7 and 8 through openings 12A by means of, for example, a tremie pipe 22. Then, the concrete placed is compacted with a rod vibrator 14 as in the method previously described. After this, the openings 12A, through which the concrete 6 has been placed, are closed by welding steel plates.

In the two conventional methods above stated, concrete 6 is placed by means of chutes 10 or tremies 22 which are inserted through open ends 12 or openings 12A and hence the height of concrete placing is limited by levels, to which rod vibrators 14, chutes 10 and tremies 22 can reach, as well as by allowable pressure of the concrete 6 applied to steel encasements 7 and 8. Thus, in the method in FIG. 5, concrete is placed into a steel encasement piece, to which another steel encasement piece is then welded to be disposed above it. By repeating these operations a slanted wall or a vertical wall is constructed to a predetermined height. Thus, the number of assembly operations and welding operations for constructing the slanted and vertical walls are increased, so that the construction cost and the construction period of both the slanted walls and the vertical walls are increased.

On the other hand, the method illustrated in FIG. 6 reduces the number of assembly operations and welding operations, but a large number of wide openings 12A must be formed due to the height limit of concrete placing mentioned above and closed after the placing of concrete. These also raise the construction cost and prolong the construction period. Further, chutes 10, tremie pipes 22 and other equipments must be disposed in place before the concrete placement and then removed. Such operations further increase the construction cost and period.

SUMMARY OF THE INVENTION

Accordingly, it is an object of the present invention to provide a method of placing concrete into a steel encasement for constructing a composite member, in which method the construction cost and the construction period of the composite member are reduced.

With this and other objects in view, the present invention provides a method of placing concrete into a steel encasement. The steel encasement is erected. A plurality of first concrete injection holes are formed through the steel encasement in a heightwise spaced manner. The concrete is injected through the lowest disposed concrete injection hole into the erected steel encasement to a level below another concrete injection hole disposed just above said lowest disposed concrete injection hole. Then, the injection step is repeated in connection with a subsequent first concrete injection hole nearest to the level, to which the concrete has been placed, for placing the concrete into the steel encasement to a predetermined level.

The present invention may be applied to construction of other concrete structures or elements thereof such as concrete filled steel tube columns, chimneys, silos and nuclear shells.

BRIEF DESCRIPTION OF THE DRAWINGS

The invention will now be described by way of example with reference to the accompanying drawings in which.

DETAILED DESCRIPTION OF THE PREFERRED EMBODIMENTS

Figure 1:
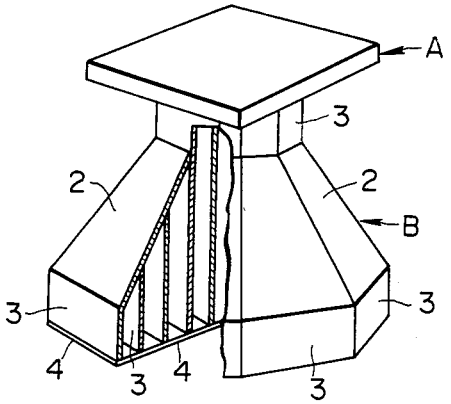
FIG. 1 is a perspective view, partly in section, of a composite-type offshore platform.
Figure 4A:
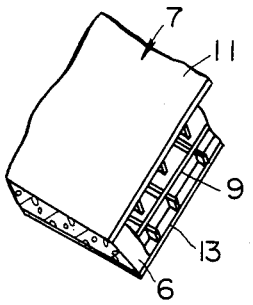
FIG. 4A is an enlarged, partial perspective view of each of slanted walls in FIG. 1.
Figure 4B:
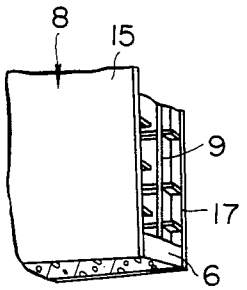
FIG. 4B is an enlarged, partial perspective view of each vertical wall in FIG. 1.
Figure 2:
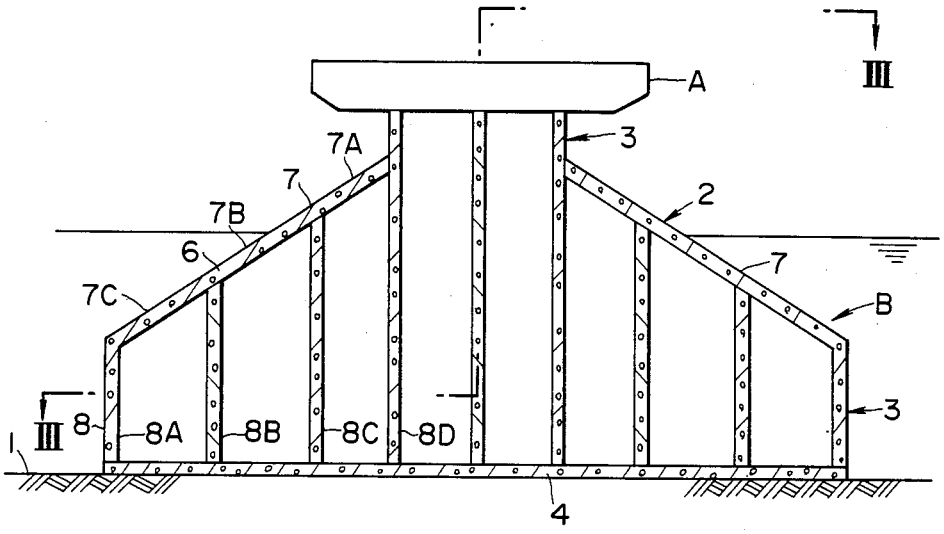
FIG. 2 is an enlarged diagrammatic illustration in axial section of the offshore platform in FIG. 1.

One embodiment of the present invention will be described with reference to FIGS. 7 to 11, in which the offshore platform is substantially the same in structure as the offshore platform of the prior art already stated. Hence, like reference characters designate corresponding parts throughout views and descriptions thereof are omitted after once given.

Figure 7:
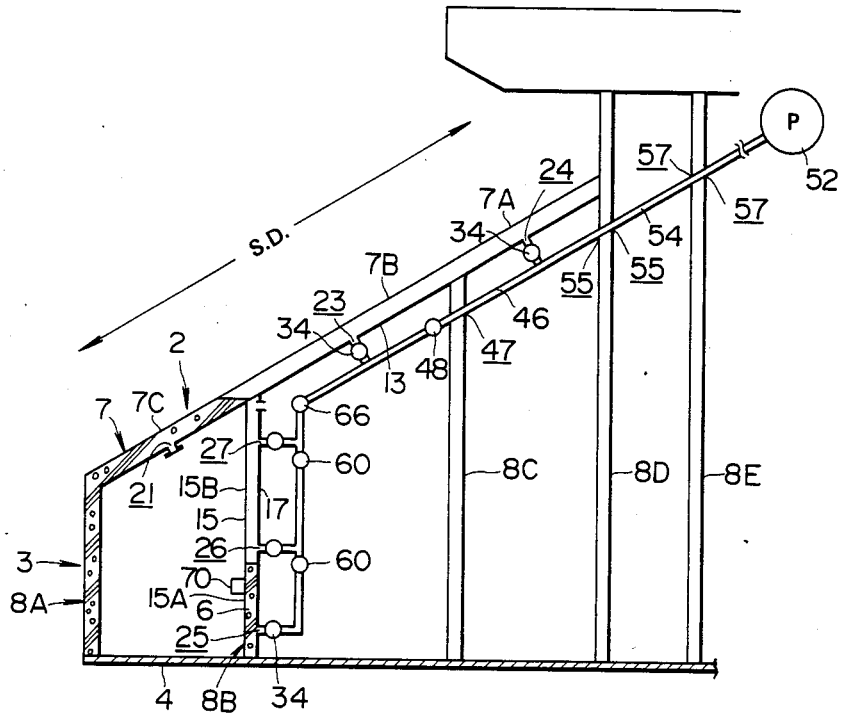
FIG. 7 is a diagrammatic illustration in axial section of part of steel encasements of a composite-type offshore platform in which concrete is placed according to the present invention.
Figure 9:
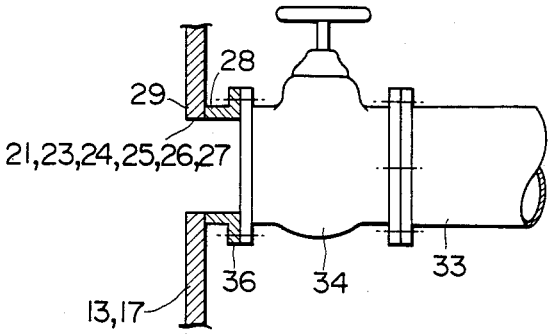
FIG. 9 is an enlarged view of the valve in FIG. 7 which is attached to the associated concrete injection hole portion, illustrated in vertical section, of each steel encasement.

In this embodiment, each of the slanted steel encasements 7 has three rows of circular concrete injection holes or openings 21, 21, 21; 23, 23, 23; 24, 24, 24 formed through its lower wall plate 13 so that two adjacent rows are spaced in the slanted direction S.D., each row consisting of three concrete injection holes 21, 21, 21; 23, 23, 23; or 24, 24, 24 horizontally disposed although only one of concrete injection holes of each row is illustrated in FIG. 7. The concrete injection holes 21, 23 and 24 have a diameter of about 10 to 20 cm. The spacing of the concrete injection holes 21, 23 and 24 is about 10 m in the slanted direction S.D. and about 3 m in the horizontal direction. However, the slanted directed spacing of the concrete injection holes 21, 23 and 24 depends upon both allowable pressure on the steel encasements 7, 8 and pumping pressure of a concrete pump 52 used for pumping the concrete 6. The thickness of the upper and lower wall plates 11 and 13 is about 1 to 6 cm. As shown in FIG. 9, each slanted steel encasement 7 has flanged attachment pipes 28 welded to peripheral portions 29 of respective concrete injection holes 21, 23, 24 so that the attachment pipes 28 coaxially align with corresponding concrete injection holes 21, 23, 24. Each of the vertical steel encasements 8 also has three rows of circular concrete injection holes 25, 25, 25; 26, 26, 26; and 27, 27, 27 formed through its inner wall plate 17 so that two adjacent rows are vertically spaced, each row consisting of three concrete injection holes 25, 25, 25; 26, 26, 26; or 27, 27, 27 horizontally spaced although only one of the concrete injection holes of each row is shown in FIG. 7. The concrete injection holes 25, 26 and 27 are substantially equal in diameter and spacing to the concrete injection holes 21, 23 and 24. The inner and outer wall plates 17 and 15 are small in thickness as compared to the upper and lower wall plates 11 and 13. Each of the inner wall plates 17 is also provided with flanged attachment pipes 28 to communicate to respective concrete injection holes 25, 26, 27 as in the lower wall plates 13.

Figure 11:
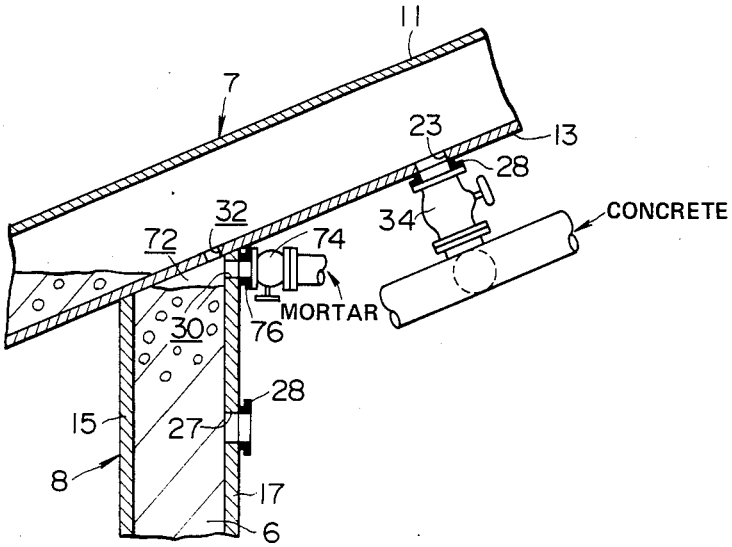
FIG. 11 is an enlarged vertical section of a connecting portion of both the slanted steel encasement and the upper end of the second vertical steel encasement in FIG. 7.

As illustrated in FIG. 11, each of the vertical steel encasements 8A, 8B, 8C . . . has three, horizontally disposed mortar injection holes 30 formed through its inner wall plate 17 above the uppermost concrete injection hole 27, 27, 27 although only one mortar injection hole 30 is illustrated. The upper end of each vertical steel encasement 8 is welded to and closed by the lower wall plate 13 of the slanted steel encasement 7, but the interior thereof is communicated to the interior of the slanted steel encasement 7 through an air vent hole 32 formed through the lower wall plate 13.

Figure 3:
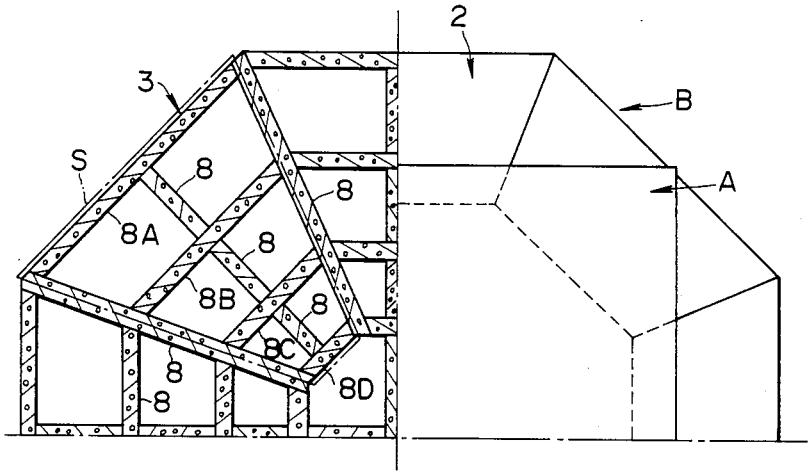
FIG. 3 is a view taken along the line III—III in FIG. 2.
Figure 5:
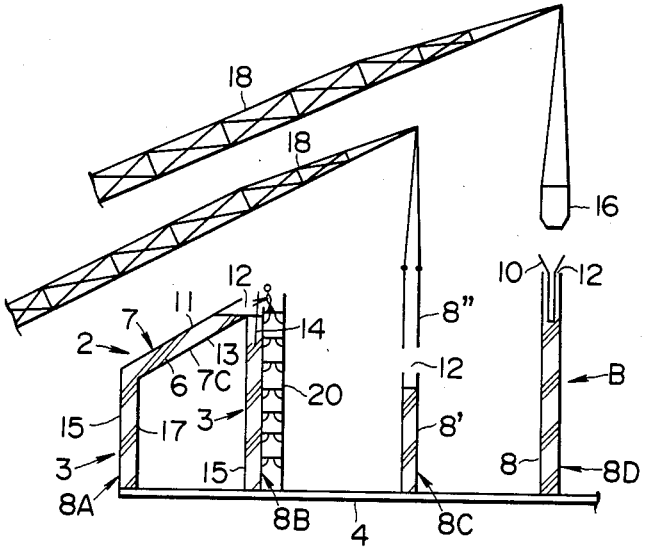
FIG.5 (PRIOR ART)
FIG. 5 is a diagrammatic illustration showing the placing of concrete into steel encasements according to the prior art.
Figure 6:
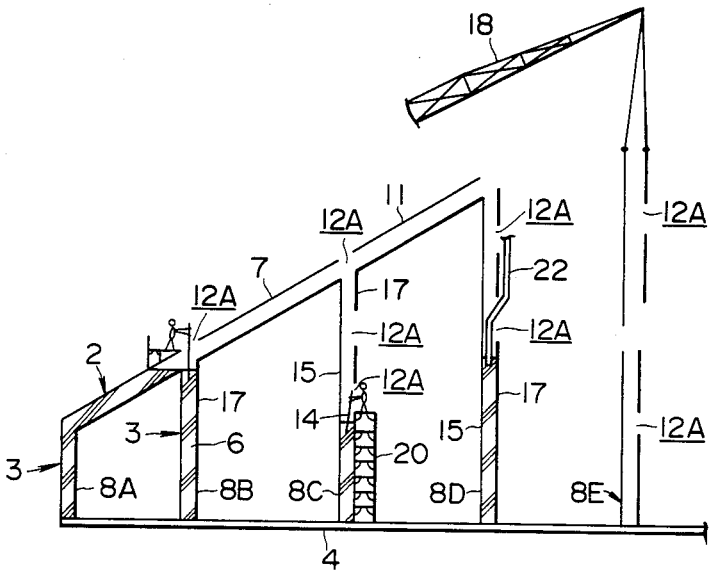
FIG.6 (PRIOR ART)
FIG. 6 is a diagrammatic illustration of another typical example of concrete placing according to the prior art.
Figure 8:
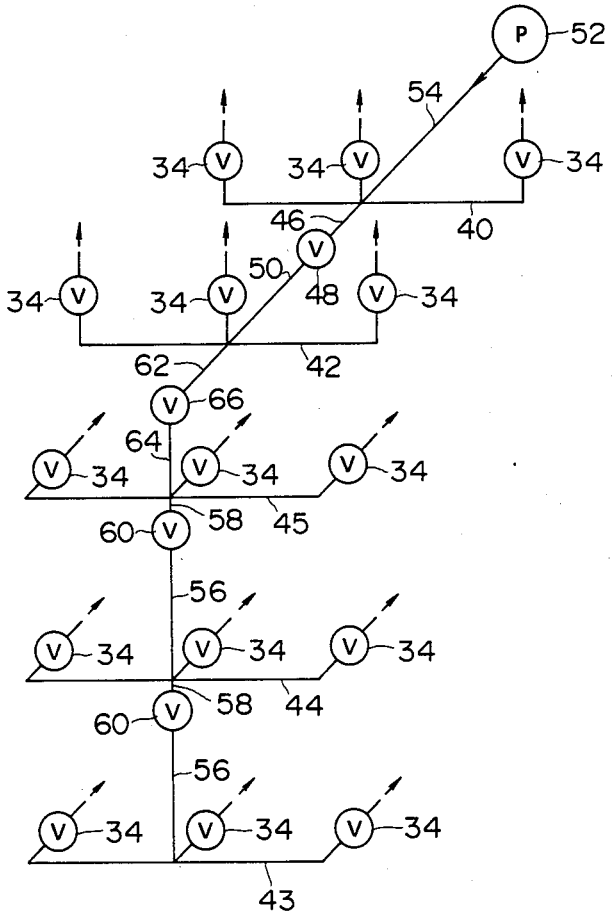
FIG. 8 is a diagram of the concrete injection piping in FIG. 7.

FIG. 7 demonstrates how to place concrete into the second vertical steel encasements 8B and the intermediate portion 7B of the slanted steel encasement 7. A valve 34 is sealingly bolted to the flange 36 of each of attachment pipes 28 of the uppermost portions 7A and the intermediate portions 7B and the second vertical steel encasement 8B for controlling the injection of concrete 6 as shown in FIGS. 9 and 11. FIG. 8 illustrates a piping arrangement for supplying concrete 6 to the uppermost portion 7A, the intermediate portion 7B and the second steel encasement 8B of a sector S, shown by the phantom lines in FIG. 3, of the supporting portion B of the offshore platform. The piping includes a horizontal branch pipe 40 for the uppermost portion 7A and a horizontal branch pipe 42 for the intermediate portion 7B, each branch pipes having three valves 34, 34 and 34 attached to outlets 33 thereof. The branch pipes 40 and 42 are connected through a connecting pipe 46, valve 48 and another connecting pipe 50, the connecting pipes 46 and 54 passing through the vertical steel encasements 8C and 8D respectively. The branch pipe 40 is communicated to a conventional concrete pump 52 through a transporting pipe 54 for receiving concrete. The piping further includes three horizontal branch pipes 43, 44 and 45 each having three valves 34 attached to outlets 33 thereof. Two adjacent branch pipes 43, 44; 44, 45 are communicated to each other through connecting pipes 56 and 58 and a valve 60 disposed between them. The uppermost branch pipe 45 is communicated to the lower branch pipe 42 for the slanted steel encasement 7 through connecting pipes 62 and 64 and a valve 66 disposed between them.

In placing concrete 6, the valves 34, 34, 34 of the lowermost branch pipe 43 and the valves 48, 66, 60, 60 are opened and the other valves 34 are closed. Then, the concrete 6 is pumped by means of the concrete pump 52 through the transporting pipe 54 and the connection pipes 46, 50, 62, 64, 58, 56, 58, 56 into the lowermost branch pipe 43 and thereafter injected into the second vertical steel encasement 8B through the opened valves 34, 34, 34 of the lowermost branch pipe 43 and the lowermost concrete injection holes 25, 25, 25. The pumping pressure in the concrete pump 52 is, for example, about 3 Kg/cm$^2$. The concrete 6 must be high in workability. Specifications of the concrete 6 are as follows:

| | |
|---|---|
| Design strength | about 457 Kg/cm$^2$ |
| Unit weight (max.) | about 1.84 t/m$^3$ |
| Slump | about 23–26 cm |
| Slump flow diameter | about 50–65 cm |

The preferable composition and the mix proportion of the concrete are disclosed in copending U.S. Pat. Ser. No. 883,916 filed by Toru Kawai et al on July 10, 1986 and entitled "FLOWING CONCRETE AND PROCESS OF PRODUCING THE SAME", of which disclosure is incorporated herein by reference. A typical example of the composition of the concrete 6 is given in Table 1 although the present invention is not limited to this composition:

TABLE 1

| | |
|---|---|
| Water-cement ratio (%) | 29 |
| Content of fine aggregate (%) | 38 |
| Water*1 (Kg/m$^3$) | 145.6 |
| Cement*2 (Kg/m$^3$) | 502 |
| Silica fume*3 (Kg/m$^3$) | 50 |
| Fine aggregate*4 (Kg/m$^3$) | 589 |
| Coarse aggregate*5 (Kg/m$^3$) | 478 |
| Superplasticizer*6 (wt. %) | 0.336–0.504 |
| Air-entraining agent*7 (wt. %) | 0.075 |
| Segregation-controlling agent*8 (wt. %) | 0–0.04 |

TABLE 1-continued

| | |
|---|---|
| Water-cement ratio (%) | 29 |
| Content of fine aggregate (%) | 38 |
| Flowing agent*9 (wt. %) | 0.18–0.48 |

*1: tap water.
*2: a cement for mass concrete sold by Daiich Cement K.K., Japan under the trade designation "Mascon Portland Blast Furnace Slag Cement B" and including 55 wt. % of slag and 45 wt. % of ordinary Portland cement.
*3: a silica fume sold by Nippon Keiso Kogyo K.K. under the trade designation "Nikke Powder" and having a specific gravity of 2.19.
*4: a product sold by Daiichi Concrete K.K., Japan and having an F.M. (fineness modulus) of 2.70, specific gravity of 2.58 and water absorption of 1.75%
*5: Mesalite (an artificial lightweight aggregate) having an specific gravity of 1.28 (absolute dry) and a water absorption of 0.1%.
*6: a soduim salt of β-naphthalenesulfonic acid/formaldehyde high condensate produced and sold by Kao K.K., Japan under the Japanese trademark "Mighty 150".
*7: sodium avidinite produced and sold by Yamaso Chemical K.K., Japan under the Japanese trademark "Vinsol"
*8: a methylcellulose sold by Shinetsu Chemical K.K. under the Japanese trademark "Hi-Metolose" (90SH-30000) and having a viscosity of 17,000 to 28,000 as measured by Brookfield type viscometer in 2% aqueous solution at 20° C.
*9: a mixture of a β-naphthalenesulfonic acid/formaldehyde high condensate and polyvinyl alcohol and the mixture sold by Kao K.K., Japan under the Japanese trademark "Mighty RD1-X".

Water, cement, silica fume, fine aggregate, coarse aggregate, superplasticizer, air-entraining agent and segregation-controlling agent as specified in Table 1 are kneaded together in a composition given in it in a forced stirring type mixer for 1.5 to 2 min to obtain a concrete mixture having a slump of about 8.5–11 cm. The amounts of the superplasticizer and air-entraining agent are those based on the cement and the amounts of segregation-controlling agent are those based on water. Then, the flowing agent is added to the concrete mixture in an amount shown in Table 1 and the concrete mixture is stirred in a drum mixer for 15 min to form a flowing concrete having a slump of about 23 cm or more. The flowing agent may be an aqueous solution of 30 wt. % of a mixture of β-naphthalenesulfonic acid/formaldehyde high condensate and polyvinyl alcohol, but in Table 1 the amounts thereof are given in terms of the solid based on the cement.

Figure 10:
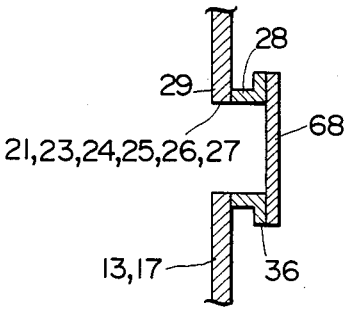
FIG. 10 is a view of the concrete injection hole portion in FIG. 9, the hole portion being closed after the valve is removed.

The concrete 6 thus prepared is placed to a level just below the intermediate concrete injection holes 26, 26, 26 as shown in FIG. 7. The filling of concrete 6 to this level is detected by measuring a temperature of the level within the steel encasement with a thermocouple (not shown) which is inserted through one of the concrete injection holes 26 into the steel encasement 8B. When the concrete 6 reaches to the level, a temperature change is detected. Then, the valves 34, 34 and 34 of the lowermost branch pipe 43 and the lower valve 60 are closed. Thereafter, the lowermost branch pipe 43 with the valves 34, 34 and 34 and the connection pipe 56, connected to the branch pipe 43, are removed for washing with water to remove concrete contained in them. These components removed are again used for the lowermost concrete injection holes 25, 25 and 25 of the third vertical steel encasement 8C. Each of the three attachment pipes 28 from which the valves 34, 34, 34 has been removed are closed by welding a steel plate 68 to its flange 36 as shown in FIG. 10. During or after this placing of concrete 6, the lowermost portion of the second steel encasement 8B is vibrated by means of a conventional form vibrator 70 for fully filling spaces between adjacent inner stiffeners 9 of the second vertical steel encasement 8B for improving placeability of concrete 6. The vibrator 70 may be a conventional vibrating electric motor which is produced, for instance, by K. K. Murakami Seiki Kosakusho, Japan and sold under Japanese trademark "Uras" vibrator. The vibrator 70 is detachably bolted to the lowermost portion 15A of the outer wall plate 15 of the second vertical steel encasement 8B.

After setting of concrete 6 thus injected, the valves 34, 34, 34 of the intermediate branch pipe 44 are opened for injecting concrete 6 through the intermediate concrete injection holes 26, 26 and 26 into the intermediate portion of the second vertical steel encasement 8B to another level just below the uppermost concrete injection holes 27, 27 and 27. Then, the upper valve 60 of the connecting pipe 56 is closed for removing the intermediate branch pipe 44 with the valves 34, 34 and 34 and the upper connecting pipe 56, which are then washed for reusing in the third vertical steel encasement 8C. The intermediate portion of the second vertical steel encasement 8B is subjected to the same vibrating operation as in the lowermost portion thereof by the vibrator 70 mounted to the intermediate portion 15B of the outer wall plate 15.

After setting of the concrete injected through the intermediate concrete injection holes 26, 26 and 26, the valves 34, 34 and 34 of the uppermost branch pipe 45 are opened for injecting concrete 6 into the uppermost portion of the second steel encasement 8B through the uppermost concrete injection holes 27, 27 and 27 to a level just below the mortar injection holes 30, 30 and 30 as shown in FIG. 11. Then, the valve 66 is closed for removing the uppermost branch pipe 45 with the valves 34, 34 and 34 and the connecting pipe 64, which are then washed for reusing in the third vertical steel encasement 8C. The uppermost portion of the second vertical steel encasement 8B is subjected to the same vibrating operation as in the lowermost portion thereof by actuating the vibrator 70 mounted to the uppermost portion 15C of the outer wall plate 15. Then, the mortar is injected through a valve 74, which is bolted to a valve attachment pipe 76 mounted on the periphery of the mortar injection hole 30, into the second vertical steel encasement 8B for filling an air space 72 above the level of the concrete 6 placed and thereafter the mortar injection hole 30 is closed by welding a closing plate (not shown) to the valve attachment pipe 76. During placing of the mortar, air is vented through the air vent hole 32.

Then, valves 34, 34 and 34 of the branch pipe 42 are opened for injecting the concrete through the concrete injection holes 23, 23 and 23 into the intermediate portion 7B of the slanted steel encasement 7 to a level just below an air vent hole 32 (not shown) for the third vertical steel encasement 8C. The valve 48 is then closed for removing the branch pipe 42 with its valves 34, 34 and 34, the connection pipes 50 and 62 and the valve 66. Thereafter, the concrete injection holes 23, 23 and 23 are closed by welding a closure plate 68 to the valve attachment 28 as shown in FIG. 10.

The above-stated operations are applied to subsequent vertical steel encasements 8C, 8D . . . and the uppermost portion 7A of the slanted steel encasement 7. Before placing concrete 6 into the vertical steel encasements 8C, 8D . . . , through holes 47 and 55, 57, . . . , which are formed there for passing connecting pipes 46, 54 . . . , are closed with steel plates or the like. Although illustration of the placing of concrete 6 is started from the second vertical steel encasement 8B and the intermediate portion 7B of the slanted steel encasement 7, in practice the placing of concrete commences in the first or the outermost vertical steel encasement 8A and the lowermost portion 7C of the slanted steel encasement 7 in the same manner as in the second vertical encasement 8B and the intermediate portion 7B of slanted encasement 7. By repeating operations above stated concrete is similarly injected into slanted steel encasements 7 and vertical steel encasements 8 of the other sectors of the offshore platform.

Although in the above-described embodiment, concrete is injected into steel encasements after setting of concrete previously injected, concrete may be continuously injected into them by controlling the speed of the concrete placing.

In the above embodiment, the upper end of each vertical steel encasement 8 is closed by the lower wall plate 13 and is communicated to the slanted steel encasement 7 through only small air vent hole 32, but the upper end may be jointed to the lower wall plate 13 so as to open to the interior of the slanted steel encasement 7. In the latter case, the upper end of the each encasement 8 is welded to the periphery of a slot formed through the lower wall plate 13 and no mortar injection hole 30 is necessary since any air space 72 is not formed when the vertical steel encasements 8 are filled with concrete 6. In case the concrete 6 is placed into the slanted steel encasement prior to the concrete placement into the vertical steel encasement, a vent hole 32 is furnished to the upper portion of the wall plate 17 of each vertical steel encasement.

What is claimed:

1. A method of placing concrete into steel encasements constructing of an offshore structure, comprising the steps of:

(a) erecting the steel encasements;

(b) forming a plurality of concrete injection holes through the walls of the steel encasements in a height-wise spaced manner with each steel encasement having uppermost and lowermost concrete injection holes;

(c) arranging concrete injection means to a first one of the erected steel encasements so that concrete may be injected through concrete injection holes of said first erected steel encasement, the concrete injection means including concrete injection devices connected to corresponding concrete injection holes of said first erected steel encasement for injection of concrete;

(d) after the arranging step (c), injecting concrete into the first erected steel encasement through the lowermost concrete injection hole thereof by means of a corresponding concrete injection device to a level below a second concrete injection hole thereof disposed just above said lowermost concrete injection hole of said first erected steel encasement;

(e) after the injection step (d), removing the concrete injection device corresponding to the lowermost concrete injection hole from said first erected steel encasement;

(f) rearranging said removed concrete injection device from the lowermost concrete injection hole of said first erected steel encasement, to the lowermost injection hole of a second erected steel encasement for injection of concrete;

(g) repeating the injection step (d) for said first erected steel encasement in connection with a second concrete injection hole disposed just above the lowermost concrete injection hole so that the concrete is placed to a level disposed just below a third concrete injection hole;

(h) after the repeating step (g), removing said concrete injection device corresponding to the second concrete injection hole of said first erected steel encasement;

(i) rearranging the concrete injection device, removed from the second concrete injection hole of said first erected steel encasement, to a concrete injection hole, formed just above the lowermost injection hole of said second erected steel encasement for injection of concrete;

(j) after the rearranging step (f), repeating the injection step (d) in connection with the lowermost concrete injection hole of said second erected steel encasement;

(k) after the rearranging step (i), repeating the injection step (d) in connection with the concrete injection hole, formed just above the lowermost injection hole, of said second erected steel encasement;

(l) continuing said rearranging and injecting steps until the concrete is injected through said uppermost concrete injection hole of each erected steel encasement, so that each of said erected steel encasements are filled with concrete; and (m) after each of said steel encasements are filled with concrete, removing said concrete injection devices and sealing said concrete injection holes, said concrete injection holes are formed in horizontal rows corresponding to said erected steel encasements, including a horizontal row of uppermost concrete injection holes and a horizontal row of lowermost concrete injection holes, wherein the steps (c) to (m) are carried out with respect to each of said horizontal rows of concrete injection holes; said steel encasements including wall plates each having an inner face, and wherein the wall plates have stiffeners integrally mounted on said inner faces thereof.

2. A method as recited in claim 1, further comprising after each of the injecting steps, the step of applying vibration to the concrete encasement for enhancing the placeability of the concrete injected through each of said concrete injection holes.

3. A method as recited in claim 2, wherein the step of forming said concrete injection holes includes the step of forming a mortar injection hole through each of said steel encaements at a position above the uppermost concrete injection hole for injecting mortar into each of said steel encasements, and further comprising the step of injecting mortar through said mortar injection holes into each of said steel encasements for filling an air space within each of said steel encasements after the concrete has been injected through the uppermost concrete injection hole of each of said steel encasements.

4. A method as recited in claim 1, wherein the step of forming said concrete injection holes includes the step of forming a mortar injection hole through each of said steel encasements at a position above the uppermost concrete injection hole for injecting mortar into each of said steel encasements, and further comprising the step of injecting mortar through said mortar injection hole into each of said steel encasements for filling in air space within each of said steel encasements after the concrete has been injected through the uppermost concrete injection hole of each of said steel encasements.

5. A method as recited in claim 1, 2, 3 or 4, wherein the erecting step (a) comprises erecting a plurality of veritcal steel encasements in different height and each having an upper end, and further comprising the steps of: (n) jointing the upper end of each of said vertical steel encasements with steel encasements disposed in a slanted direction; (o) forming concrete injection holes through the walls of said slanted steel encasements so that said concrete injection holes are spaced along the length of each of said slanted steel encasements and include a lowermost and uppermost concrete injection hole; (p) after step (m), injecting the concrete through said lowermost disposed concrete injection hole into one of said slanted steel encasements to a level below a subsequent concrete injection hole disposed just above said lowermost disposed concrete injection hole; (g) repeating the injection step (d) in connection with said subsequent concrete injection holes until the concrete has been placed to a predetermined level corresponding to said uppermost concrete injection hole.

6. A method as recited in claim 5, further comprising after each injecting step, the step of applying vibration to the concrete encasement for enhancing placeability of the concrete injected through each of said concrete injection holes.

7. A method as recited in claim 6, wherein the step of forming said concrete injection holes includes the step of forming a mortar injection hole through said slanted steel encasement at a position above the uppermost concrete injection hole for injecting mortar into said slanted steel encasement, and further comprising the step of injecting mortar through said mortar injection hole into said slanted steel encasement for filling an air space within said slanted steel encasement after the concrete has been injected through the uppermost concrete injection hole of said slanted steel encasement.

8. A method as recited in claim 5, wherein the step of forming said concrete injection holes includes the step of forming a mortar injection hole through said slanted steel encasement at a position above the uppermost concrete injection hole for injecting mortar into said slanted steel encasement, and further comprising the step of injecting mortar through said mortar injection hole into said slanted steel encasement for filling an air space within said slanted steel encasement after the concrete has been injected through the uppermost concrete injection hole of said slanted steel encasement.

* * * * *